US007674140B2

(12) United States Patent
Eppe et al.

(10) Patent No.: US 7,674,140 B2
(45) Date of Patent: Mar. 9, 2010

(54) MODULAR SERVICE SWITCHING DEVICE

(75) Inventors: Klaus-Peter Eppe, Waldbrunn (DE); Carola Thielen, Birkenau-Loehrbach (DE)

(73) Assignee: ABB Patent GmbH, Ladenburg (DE)

( * ) Notice: Subject to any disclaimer, the term of this patent is extended or adjusted under 35 U.S.C. 154(b) by 191 days.

(21) Appl. No.: 11/873,432

(22) Filed: Oct. 17, 2007

(65) Prior Publication Data

US 2008/0096441 A1 Apr. 24, 2008

(30) Foreign Application Priority Data

Oct. 21, 2006 (DE) ..... 10 2006 049 773

(51) Int. Cl.
*H01R 4/48* (2006.01)

(52) U.S. Cl. ..... 439/816

(58) Field of Classification Search ..... 439/816, 439/835, 826, 630, 260, 76.1, 834
See application file for complete search history.

(56) References Cited

U.S. PATENT DOCUMENTS 6,004,168 A * 12/1999 Fuchs et al. ..... 439/835
6,010,376 A * 1/2000 Kollmann ..... 439/834
7,094,071 B2 * 8/2006 Hackemack et al. ..... 439/76.1
7,234,981 B2 6/2007 Eppe et al.
7,287,999 B2 * 10/2007 Holterhoff et al. ..... 439/441
7,510,448 B2 * 3/2009 Eppe et al. ..... 439/835
2008/0083097 A1 * 4/2008 Lang et al. ..... 24/305

FOREIGN PATENT DOCUMENTS

EP 1 575 130 9/2005

* cited by examiner

*Primary Examiner*—Jean F Duverne
(74) *Attorney, Agent, or Firm*—Buchanan Ingersoll & Rooney PC

(57) ABSTRACT

The disclosure relates to a service switching device having a housing, having a front face side, a rear face side, having front and rear narrow sides connecting the front and rear face sides, having lateral broad sides, a fastening side, having at least one screwless terminal connection, which is fixed in position in a terminal connection area in the interior of the housing, for connecting connecting conductors by fixedly clamping them with a clamping spring, which acts as a compression spring on the connecting conductor ends, fixedly clamps them in a window-like cutout of a busbar and has a number of spring elements which corresponds to the number of connecting conductors to be connected. The housing wall has, in the region of the terminal connection, a number of connection openings for in each case one connecting conductor which corresponds to the number of connecting conductors to be connected, and each connection opening is associated with a spring element in such a way that each connecting conductor can be clamped with the other connecting conductors against a common clamping edge of only one window-like cutout.

19 Claims, 2 Drawing Sheets

MODULAR SERVICE SWITCHING DEVICE

RELATED APPLICATIONS

This application claims priority under 35 U.S.C. §119 to German Application 10 2006 049 773.2 filed in Germany on Oct. 21, 2006, the entire contents of which are hereby incorporated by reference in their entireties.

TECHNICAL FIELD

A modular service switching device is disclosed having a housing, having a front and rear face side, having front and rear narrow sides connecting the front and rear face sides, having lateral broad sides, having a fastening side, having at least one screwless terminal connection, which is fixed in position in a terminal connection area in the interior of the housing, for connecting connecting conductors by fixedly clamping them with a clamping spring, which acts as a compression spring on the connecting conductor ends, fixedly clamps them in a window-like cutout of a busbar and has a number of spring elements which corresponds to the number of connecting conductors to be connected.

BACKGROUND INFORMATION

A generic service switching device may be, for example, a line circuit breaker which comprises at least one contact point within its housing having at least one fixed and one moveable contact piece, via which contact point a current path leading from an input terminal to an output terminal can be opened and closed. The contact point is generally actuated by a switching mechanism with a latching point. Such a line circuit breaker may furthermore comprise tripping apparatuses, for example a thermal release or a magnetic quick-action release, which, in the event of a short-circuit current or residual current in the current path, act on the contact point or the switching mechanism so that the contact point is opened.

In Germany, a so-called standard module width of 17.5 mm has been passed for the installation width of line circuit breakers.

A generic service switching device may also be, however, an auxiliary switch for attachment to a line circuit breaker. Such attachment auxiliary switches are switched at the same time as the main poles and serve the purpose of disconnecting or connecting circuits. They can be used for many purposes, for example for switching optical or acoustic signals, which indicate the switching state of the main circuit. Auxiliary switches can have, in separate current paths, a plurality of auxiliary contacts, which are DC-isolated from one another and to which in each case one or two connecting conductors can be connected on the incoming and outgoing side. The attachment auxiliary switches generally only take up a width of half the standard module width, i.e. approximately 8.75 mm.

For connection to external connecting conductors, screw terminals are used in generic service switching devices. Single-module devices have also been disclosed in which screwless terminal connections are used on the outgoing side. In this case, plug-type terminals or spring-loaded terminals can be used as the clamping elements. In principle, these can considerably simplify the connection of connecting conductors since it is no longer necessary to fasten a screw using a screwdriver during fitting but instead the connecting conductor can be simply inserted into the terminal and is then held fixedly by the terminal element itself. If it is intended for more than one connecting conductor to be connected by means of a clamping element, each of the connecting conductors needs to be capable of being inserted and removed again without influencing the other connecting conductors.

EP 1 575 130 has disclosed a terminal connection in which a plurality of plug-type openings are provided in a contact frame. The clamping spring is split at its free end into a number of finger-like protrusions which corresponds to the number of plug-type openings by means of one or more slot-shaped cutouts. Each of the protrusions is passed through in each case one of the plug-type openings, and a conductor can be clamped fixedly in each of the plug-type openings by in each case one of the protrusions. Thereby each connecting conductor can be inserted and removed without influencing the other connecting conductors. In the case of a terminal connection in accordance with EP 1 575 130, only one narrow web is provided on the contact frame for the current path from a clamped-on connecting conductor to an outgoing conductor in the interior of the device. The transfer resistance from the clamped-on connecting conductor to the further electrical outgoing conductor into the switching device is correspondingly high. Since a dedicated connection window, separated by a transverse web, is available for each connecting conductor to be clamped on, the terminal connection in accordance with EP 1 575 130 is so wide that it does not fit into switching devices with only half the standard module width.

SUMMARY

It is therefore the object of the disclosure to improve a generic service switching device with screwless terminal connections in such a way that it can also be constructed as a half-module device with terminal connections.

According to the disclosure, the housing wall has, in the region of the terminal connection, a number of connection openings for in each case one connecting conductor which corresponds to the number of connecting conductors to be connected, and each connection opening is associated with a spring element in such a way that each connecting conductor can be clamped with the other connecting conductors against a common clamping edge of only one window-like cutout.

The exemplary service switching device now consists in the fact that the terminal connection can be constructed to be very narrow, since now only a window-like cutout for accommodating the connecting conductors to be clamped on is provided. The separation and guidance of the connecting conductors takes place by means of the separated connection openings in the housing wall and the separated spring elements of the clamping spring associated therewith. The connecting conductors can therefore be inserted independently of one another into a common window-like cutout.

In an exemplary embodiment, an insertion channel is associated with each connection opening for guiding the connecting conductor to be connected to said connection opening. The guidance of each of the connecting conductors into the one common window-like cutout is further improved without influencing the other connecting conductor(s) even if the housing only has half the module width.

In this case, advantageously at least one engagement opening for an actuating tool for actuating at least one of the spring elements of the clamping spring can be associated with the connection openings of each terminal connection area. It is thereby possible to also remove the connecting conductor again, once it has been inserted, by the spring elements being bent up by means of the actuating tool, namely during the removal, to such an extent that the connecting conductor can be withdrawn. Even when connecting conductors with flexible conductor ends are inserted, the spring element is first opened by means of the actuating tool and then released again once the flexible conductor end has been inserted.

In accordance with an exemplary embodiment, a service switching device according to the disclosure can also have two or more terminal connections in two or more terminal connection areas. The two or more terminal connection areas are then arranged in the housing in a common plane parallel to the broad side and such that they are offset with respect to one another in terms of height above the fastening side. It is thus possible to accommodate a plurality of terminal connections in a service switching device according to the disclosure in such a way that they are electrically isolated from one another.

Advantageously, the connection opening associated with a first terminal connection is then in a rear face side, and the connection openings associated with a second or further terminal connection are provided in the narrow side of the housing which adjoins the rear face side. It is thus possible to make advantageous use of the restricted space on the housing surface, in particular in the case of half-module devices, in such a way that the connection terminals are sufficiently far removed from one another to be electrically isolated from one another even in the case of possibly occurring relatively high voltages between them.

With respect to an advantageous configuration of a service switching device according to the disclosure, the busbar of the terminal connection comprises a connection end and a deflecting region adjoining said connection end. The window-like cutout in the busbar has a supporting edge and a clamping edge opposite the supporting edge at the transition between the connection end and the deflecting region. The clamping spring has a supporting limb, with which it is supported on the supporting edge of the busbar. A bow-shaped segment adjoins the supporting limb, and a clamping limb with a longitudinal slot adjoins said bow-shaped segment with the result that two spring elements are produced which are capable of clamping independently of one another and are associated with a connection opening, and as a result of which in each case one conductor end can be fixedly clamped between a spring element and the clamping edge in the form of an abutment.

In this case, the conductor end can advantageously be inserted into the window-like cutout from the side of the bow-shaped segment.

In accordance with a further exemplary embodiment, the busbar has approximately the form of a U, the connection end forming one U limb, and the deflecting region being formed by a transverse web and the other U limb.

A bent-up portion can be provided at the free end of the other U limb for the purpose of fastening further electrical conductors. A deflecting rail can be integrally formed on the free end of the other U limb. In this case, the deflecting rail can advantageously run approximately at right angles to the other U limb, and the side of the connection end which is opposite the clamping edge can be supported on the deflecting rail. This makes an even more compact and intrinsically stable design of the terminal connection possible, even in the case of a housing width of only half a module.

BRIEF DESCRIPTION OF THE DRAWINGS

The disclosure and further advantageous configurations and improvements of the disclosure shall be explained and described in more detail with reference to the drawings, in which an exemplary embodiment of the disclosure is illustrated and in which.

Identical or functionally identical components or elements have each been provided with the same reference numerals in the figures, even if they have a slightly modified form in various embodiments.

DETAILED DESCRIPTION

Figure 1:
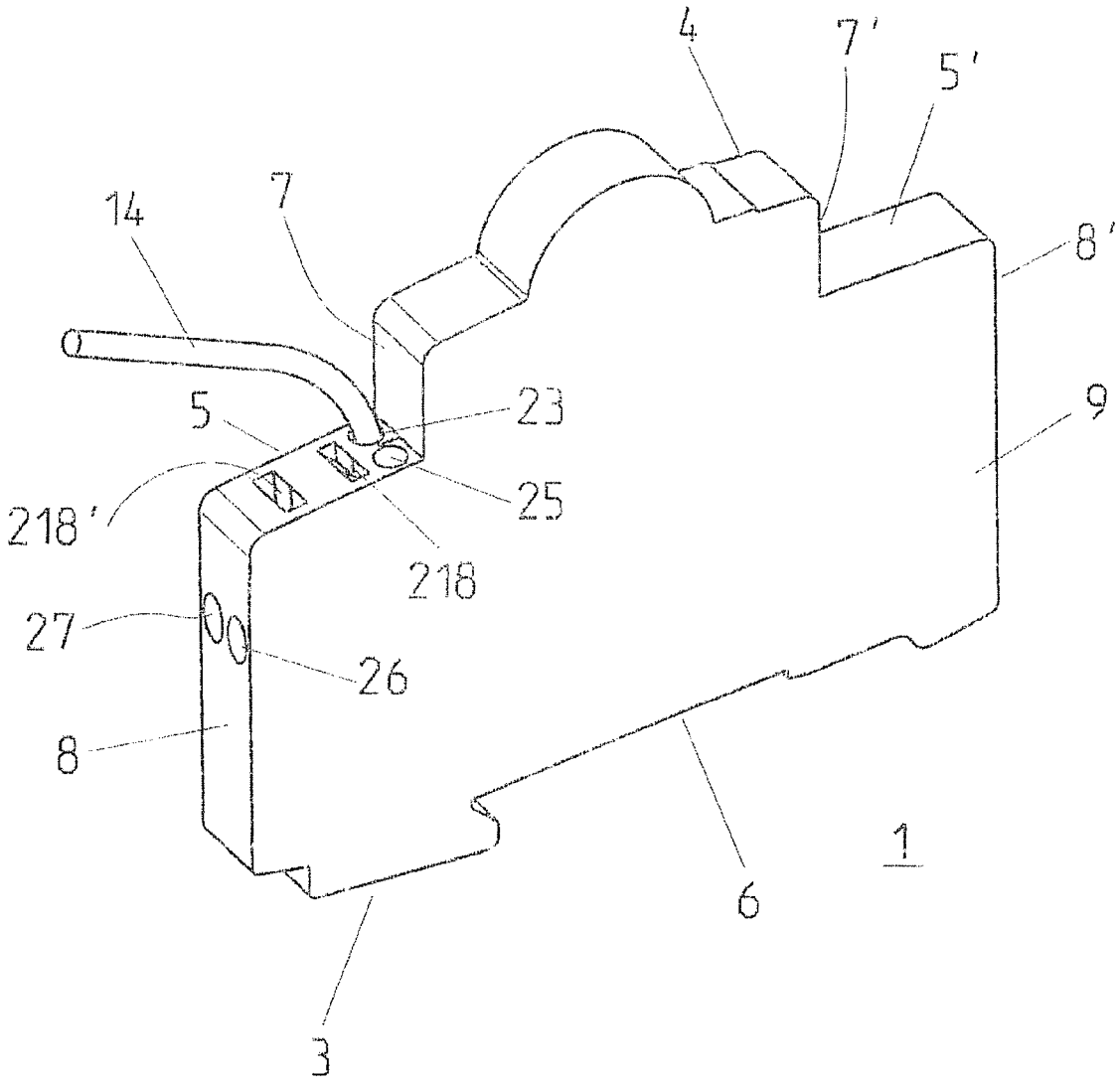
FIG. 1 shows a schematic view of a service switching device according to the disclosure having half the module width.

FIG. 1 shows a service switching device 1 according to the disclosure having an insulating housing 3, which has half the module width. The insulating housing 3 has a front face side 4, rear face sides 5, 5', a fastening or connection side 6, at which a cutout with a tab is provided, by means of which tab the service switching device 1 can be snapped onto a standard mounting rail, for example a top-hat rail, in addition to a further service switching device, and broad sides 9, of which only one is illustrated in the view shown in FIG. 1. The rear face sides 5, 5' are connected to the fastening side 6 via rear narrow sides 8, 8', and the front face side 4 is connected to the rear face sides 5, 5' via front narrow sides 7, 7'.

In the rear face side 5, in the vicinity of the transition to the front narrow side 7, two connection openings 23, 25 for inserting connecting conductors are introduced next to one another. FIG. 1 illustrates, by way of example, a connecting conductor 14 inserted in the connection opening 23. The two connection openings 23, 25 are associated with a first terminal connection area 18, which is located in the interior of the housing and is not shown in FIG. 1, having a first screwless terminal connection 10 (see FIG. 2). In the vicinity of the two connection openings 23, 25, a rectangular engagement opening 218 is introduced into the housing wall, in this case into the rear face side 5. This opens up a first engagement channel 219, through which the clamping spring 12, which, in the first terminal connection area 18, is associated with the two connection openings 23, 25, can be actuated by a screwdriver as the actuating tool.

Two further connection openings 26, 27 lying next to one another are introduced in the rear narrow side 8. These connection openings 26, 27 are associated with a second terminal connection area 18', which is likewise located in the interior of the housing 3 and is not shown in FIG. 1, having a screwless terminal connection 10' (See FIG. 2). In the rear face side 5, in the vicinity of the connecting edge to the rear narrow side 8, a second engagement opening 218' is introduced which opens up access to the second terminal connection 10' for its actuation by means of an actuating tool through a second engagement channel 219' running in the interior of the housing approximately along the rear narrow side 8 in the direction of the second clamping spring 12'.

Figure 2:
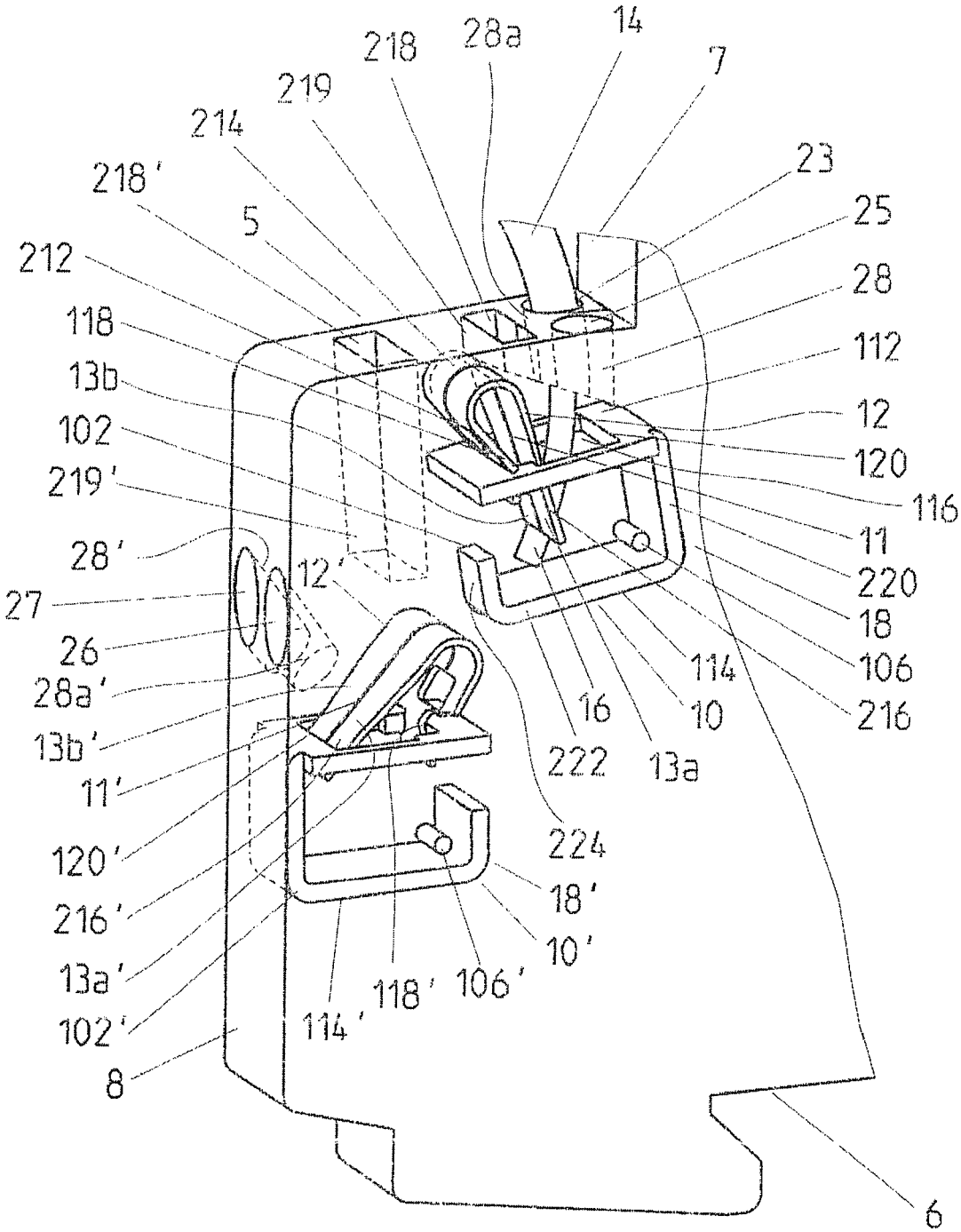
FIG. 2 shows an enlarged, schematic view of the terminal connections of the service switching device shown in FIG. 1.

FIG. 2 will now be considered. Each of the two terminal connections 10 and 10' is a so-called plug-type terminal connection. The reference numerals without apostrophes relate to the upper terminal connection 10, and the reference numerals with apostrophes relate to the lower terminal connection 10'. The description of the terminal connections is given using the example of the upper terminal connection 10. The lower terminal connection 10' has substantially the same design, and the elements described in the terminal connection 10 have the same reference numerals for the terminal connection 10', in each case supplemented by an apostrophe.

The terminal connection 10 comprises a busbar 102 and a clamping spring 12. The terminal connection 10 rests on a projection, which is not illustrated here and is formed in the interior of the housing 3, and is fixed in position in a manner known per se in the terminal connection area 18 by means of webs and pins, of which only one pin 106 is illustrated here by way of example. The busbar 102 comprises a connection end 112 and a deflecting region 114 adjoining said connection end. At the connection end 112 it has a window-like cutout 116 having a supporting edge 118 and a clamping edge 120 which is opposite the supporting edge. The clamping edge 120 is located at the transition between the connection end 112 and the deflecting region 114 and is further away from the rear narrow side 8 than the supporting edge 118.

The clamping spring 12 has a supporting limb 212, with which it is supported on the supporting edge 118 of the busbar 102. It can be supported in such a way that the supporting limb 212 has a bent-up portion (not illustrated) at its free end, with which bent-up portion it partially surrounds the supporting edge 118 for the purpose of supporting it.

A bow-shaped segment 214 adjoins the supporting limb 212 and a clamping limb 216 adjoins the said bow-shaped segment. The conductor end 16, from which the insulation has been stripped, of a connecting conductor 14 is plugged though the connection opening 23 and inserted into the window-like cutout 116 through an insertion channel 28*a* associated with the connection opening from the side of the bow-shaped segment 214. It can therefore be clamped fixedly between the clamping limb 216 and the clamping edge 120, which acts as an abutment. The free end of the clamping limb 216 in the process passes through the window-like cutout 116.

The clamping limb 216 is slit longitudinally along a slot 11, with the result that two spring elements 13*a*, 13*b* are produced which are capable of clamping independently of one another and with which two connecting conductors can be clamped on the same clamping edge 120 independently of one another. The two connecting conductors are each plugged through a dedicated connection opening 23, 25 and guided in separate insertion openings, with the result that the connecting conductors are separated by the connection openings and the insertion openings.

The busbar 102 has an approximately U-shaped basic shape, the connection end 112 forming the first U limb and the deflecting region 114 being formed by a transverse web 220 and the second U limb 222. A bent-up portion 224 is fitted to the free end of the second U limb 222. Further connecting conductors can be fitted at this bent-up portion 224, with which connecting conductors the terminal connection 10 is connected to further assemblies within the switching device housing. In particular, the connecting conductors can be welded, hard-soldered, screwed or riveted to this bent-up portion.

A design of the busbar as illustrated has the advantage that the forces acting on the terminal connection 10 when the connecting conductor is inserted and released are absorbed by said terminal connection as a closed system, and therefore forces on further elements of the service switching device, such as the housing, for example, are reduced.

The busbar 102 can be produced, for example, in the form of a stamped bent part in very large production numbers in a cost-effective and simple manner and with a wide variety of shapes.

If a connecting conductor is now intended to be inserted into the terminal connection with a rigid conductor end through a connection opening, the rigid connecting conductor presses the spring element associated with the connection opening so far away from the clamping edge 120 that the conductor end passes through the window-like cutout 116 and finally is pressed against the clamping edge 120 owing to the opposing force of the spring element. If a second connecting conductor is plugged through the second connection opening, it bends the spring element associated with the second connection opening and is likewise pressed against the clamping edge 120 owing to the resetting force of said spring element. The two connecting conductors do not influence one another mechanically, however.

If connecting conductors are intended to be inserted with the flexible conductor end, first the corresponding spring element is bent by means of an actuating tool through the engagement channel 219 and the engagement opening 218, so that the flexible conductor end can then be inserted without meeting any resistance. If the actuating tool is then removed, the spring element, owing to its resetting force, presses the flexible conductor end against the clamping edge 120.

In order to also be able to attach two connecting conductors with flexible conductor ends, uninfluenced by one another, to the terminal connection 10, the engagement channel 219 can be split in two by a central web, so that two separate engagement channel elements are produced, each of which is associated with one of the two spring elements and permits the actuation only of the spring element associated with it. This variant is not illustrated in the figures.

The same applies to the procedure for removing one of the inserted and fixedly clamped conductor ends. First the spring element is bent back by means of the actuating tool through the engagement channel 219, so that the conductor ends are released and can be withdrawn.

Owing to the use of a terminal connection having the design described above, it is for the first time possible to provide a screwless terminal connection with which a plurality of connecting conductors can be clamped on independently of one another and withdrawn again, even in a service switching device with only half the module width.

FIG. 2 furthermore illustrates an arrangement of two terminal connections 10, 10' in two terminal connection areas 18, 18' in a service switching device according to the disclosure. The second terminal connection area 18' with the second terminal connection 10' is located in the vicinity of the rear narrow side 8. The connection openings 27 and 26 associated with it are introduced in the rear narrow side 8. The insertion channels 28' 28*a'* associated with the two connection openings 27, 26 run obliquely with respect to the rear narrow side 8 towards the clamping limb 216' of the clamping spring 12'. This ensures guidance of the connecting conductor at an angle with respect to the rear narrow side 8.

This is advantageous for the accessibility of the connection openings 27, 26 if a service switching device according to the disclosure is mounted in a row arrangement with other service switching devices on a standard mounting rail, for example in a distribution board housing. Then, namely the rear narrow side 8 points upwards, for example, and it is favourable if the connecting conductors can be inserted at the connection openings 27, 26 at an acute angle with respect to the rear narrow side 8.

The second terminal connection 10', given an otherwise identical design to the first terminal connection 10, is introduced in the housing in such a way that the clamping limb 216' of the clamping spring 12' points towards the insertion channels 28*a'*, 28'. This results in an approximately mirror-image arrangement of the two terminal connections 10, 10' in the housing.

Owing to the offset of the two terminal connections 10, 10' in terms of height above the fastening side 6, it is ensured that the two terminal connections 10, 10' have a sufficiently large distance from one another so that electrical insulation is ensured between them in any operating state of the service switching device.

For example, the terminal connection 10 can be provided for the connection of a phase and the terminal connection 10' can be provided for the connection of the neutral conductor in a line circuit breaker or an auxiliary switch with half the module width.

The engagement channel 219' associated with the second terminal connection 10' in the embodiment shown in FIG. 2, runs from the rear face side 5 approximately along the rear narrow side 8 towards the clamping spring 12'. This has the advantage that the access for the actuating tool for both terminal connections takes place from the same side of the device.

Of course the second engagement channel 219' could also be fitted to the rear narrow side 8 in the vicinity of the two connection openings 27, 26, and, from the engagement opening 218', likewise point inwards at an angle with respect to the clamping limb 216' of the clamping spring 12', for example. However, a variant is also conceivable in which the engagement channel 219' runs at right angles with respect to the rear narrow side 8.

Moreover, the disclosure is of course not restricted to the exemplary embodiment shown. In particular, more than two terminal connections with spring clamps according to the disclosure can also be arranged in a service switching device according to the disclosure.

LIST OF REFERENCE SYMBOLS

1 Service switching device
3 Housing
4 Front face side
5, 5' Rear face side
6 Fastening side
7, 7' Front narrow side
8, 8' Rear narrow side
9 Broad side
10, 10' Screwless terminal connection
11, 11' Slot in clamping limb
12, 12' Clamping spring
13*a, b*, 13*a'*, 13*b'* Spring elements
14 Connecting conductor
16 Connecting conductor end from which insulation has been stripped
18, 18' Terminal connection area
23 Connection opening
25 Connection opening
26 Connection opening
27 Connection opening
28, 28*a*, 28', 28*a'* Insertion channel
102, 102' Busbar
106, 106' Pin
112, 112' Connection end
114, 114' Deflecting region
116 Window-like cutout
118, 118' Supporting edge
120, 120' Clamping edge
212, 212' Supporting limb
214 Bow-shaped segment
216, 216' Clamping limb
218, 218' Engagement opening
219, 219' Engagement channel
220 Transverse web
222 Second U limb
224 Bent-up portion

What is claimed is:

1. A modular service device comprising:

a housing with a front face side, a rear face side, front and rear narrow sides connecting the front and rear face sides, lateral broad sides, and a fastening side; and at least one screwless terminal connection, which is fixed in position in a terminal connection area in an interior of the housing, for connecting conductors by fixedly clamping them with a clamping spring, which acts as a compression spring on connecting conductor ends, fixedly clamps them in a window-like cutout of a busbar and has a number of spring elements which corresponds to a number of connecting conductors to be connected, wherein a housing wall has, in the terminal connection area, a number of connection openings for in each case one connecting conductor which corresponds to the number of connecting conductors to be connected, and each connection opening is associated with a spring element to clamp each connecting conductor by a spring element against a clamping edge, which is common to the connecting conductors of the window-like cutout.

2. Service switching device according to claim 1, wherein an insertion channel is associated with each connection opening for guiding the connecting conductor to be connected to said connection opening.

3. Service switching device according to claim 1, wherein at least two terminal connections are arranged in at least two terminal connection areas in the housing in a common plane parallel to at least one of the lateral broad sides and such that they are offset with respect to one another in terms of height above the fastening side.

4. Service switching device according to claim 1, wherein at least one engagement opening for an actuating tool for actuating a clamping limb of the clamping spring is associated with the connection openings of each terminal connection area.

5. Service switching device according to claim 1, wherein the connection openings associated with a first terminal connection are provided in a rear face side, and the connection openings associated with a second terminal connection are provided in the rear narrow side of the housing, which narrow side adjoins said rear face side.

6. Service switching device according to claim 1, wherein the housing has half a standard module width.

7. Service switching device according to claim 1, wherein the busbar of the terminal connection comprises a connection end and a deflecting region adjoining said connection end, the window-like cutout in the busbar has a supporting edge and a clamping edge which is opposite the supporting edge at a transition between the connection end and the deflecting region, the clamping spring has a supporting limb, with which it is supported on the supporting edge of the busbar, and a bow-shaped segment adjoins the supporting limb, and a clamping limb with a longitudinal slot adjoins said bow-shaped segment, such that two spring elements are produced for clamping independently of one another and are each associated with a connection opening, and in each case to clamp one conductor end fixedly between a spring element and the clamping edge as an abutment.

8. Service switching device according to claim 7, wherein the conductor end can be inserted into the window-like cutout from the side of a bow-shaped segment.

9. Service switching device according to claim 8, wherein the busbar has approximately a form of a U, the connection end forming one U limb, and the deflecting region being formed by a transverse web and the other U limb.

10. Service switching device according to claim 9, wherein a bent-up portion is provided at a free end of the other U limb for fastening further electrical conductors.

11. Service switching device according to claim 1, having one or more screwless terminal connections arranged on an outgoing side and one or more screw terminals arranged on an incoming side.

12. Service switching device according to claim 1, having one or more screwless terminal connections arranged on an outgoing side and one or more screwless terminal connections arranged on an incoming side.

13. Service switching device according to claim 2, wherein at least two terminal connections are arranged in at least two terminal connection areas in the housing in a common plane parallel to at least one of the lateral broad sides and such that they are offset with respect to one another in terms of height above the fastening side.

14. Service switching device according to claim 3, wherein at least one engagement opening for an actuating tool for actuating a clamping limb of the clamping spring is associated with the connection openings of each terminal connection area.

15. Service switching device according to claim 4, wherein the connection openings associated with a first terminal connection are provided in a rear face side, and the connection openings associated with a second terminal connection are provided in the rear narrow side of the housing, which narrow side adjoins said rear face side.

16. Service switching device according to claim 5, wherein the housing has half a standard module width.

17. Service switching device according to claim 6, wherein the busbar of the terminal connection comprises a connection end and a deflecting region adjoining said connection end, the window-like cutout in the busbar has a supporting edge and a clamping edge which is opposite the supporting edge at a transition between the connection end and the deflecting region, the clamping spring has a supporting limb, with which it is supported on the supporting edge of the busbar, and a bow-shaped segment adjoins the supporting limb, and a clamping limb with a longitudinal slot adjoins said bow-shaped segment, such that two spring elements are produced for clamping independently of one another and are each associated with a connection opening, and in each case to clamp one conductor end fixedly between a spring element and the clamping edge as an abutment.

18. Service switching device according to claim 10, having one or more screwless terminal connections arranged on an outgoing side and one or more screw terminals arranged on an incoming side.

19. Service switching device according to claim 10, having one or more screwless terminal connections arranged on an outgoing side and one or more screwless terminal connections arranged on an incoming side.

* * * * *